US009733008B2

(12) United States Patent
Koppenhaver

(10) Patent No.: US 9,733,008 B2
(45) Date of Patent: Aug. 15, 2017

(54) AIR FLOW DESIGN FOR CONTROLLING TEMPERATURE IN A REFRIGERATOR COMPARTMENT

(71) Applicant: Whirlpool Corporation, Benton Harbor, MI (US)

(72) Inventor: Brent Koppenhaver, North Liberty, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 587 days.

(21) Appl. No.: 13/799,145

(22) Filed: Mar. 13, 2013

(65) Prior Publication Data

US 2014/0273795 A1 Sep. 18, 2014

(51) Int. Cl.
*F25D 11/02* (2006.01)
*F25D 17/06* (2006.01)

(52) U.S. Cl.
CPC .... *F25D 11/02* (2013.01); *F25D 2323/00261* (2013.01); *F25D 2323/00262* (2013.01); *F25D 2323/00272* (2013.01)

(58) Field of Classification Search
None
See application file for complete search history.

(56) References Cited

U.S. PATENT DOCUMENTS 3,004,401 A * 10/1961 Mann et al. ..... 62/156
3,455,119 A * 7/1969 Bright ..... 62/180
3,590,594 A * 7/1971 Arend ..... 62/117
4,265,092 A * 5/1981 Abraham ..... A47F 3/0447 62/155
4,300,358 A * 11/1981 Hino ..... A47F 3/0447 62/256
4,481,787 A * 11/1984 Lynch ..... F25D 11/02 236/46 R
4,577,467 A * 3/1986 Ibrahim ..... F25D 21/12 165/146
4,891,952 A * 1/1990 Yoshikawa ..... F25B 5/02 62/157
5,228,499 A * 7/1993 Yoon ..... 165/263
5,546,759 A * 8/1996 Lee ..... 62/441
5,664,437 A * 9/1997 Park et al. ..... 62/407
5,675,984 A * 10/1997 Shin ..... 62/276
5,765,388 A * 6/1998 Jeon ..... 62/408
5,778,694 A * 7/1998 Jeong ..... 62/187
5,784,895 A * 7/1998 Choi ..... 62/407
(Continued)

*Primary Examiner* — Gregory Huson
*Assistant Examiner* — Eric Gorman
(74) *Attorney, Agent, or Firm* — Nyemaster Goode, P.C.

(57) ABSTRACT

Air flow designs for controlling the temperature in a temperature controlled compartment in a refrigerator are disclosed. One configuration includes a refrigerator with a cabinet having a freezer compartment and refrigerator compartment. The refrigerator may be configured with a first air return pathway between the refrigerator compartment and the freezer compartment for returning relatively warm air from the refrigerator compartment to the freezer compartment and a second air return pathway between the refrigerator compartment and the freezer compartment. A fan may be associated with the first or second air return pathway, that when activated the first or second air return pathway acts as an air supply pathway to supply cold air from the freezer compartment to the refrigerator compartment.

20 Claims, 4 Drawing Sheets

(56) References Cited

U.S. PATENT DOCUMENTS 5,839,287 A 11/1998 Stormo
5,867,994 A * 2/1999 Kopko ..... F25D 17/065 62/180
5,910,159 A * 6/1999 Matsuo ..... B60H 1/005 62/117
5,921,104 A * 7/1999 Chang ..... 62/407
5,931,004 A * 8/1999 Yoo ..... F25B 5/04 62/179
5,960,641 A * 10/1999 Kim et al. ..... 62/407
5,979,174 A * 11/1999 Kim et al. ..... 62/404
5,992,164 A * 11/1999 Kim ..... 62/186
6,041,616 A * 3/2000 Jeong ..... 62/419
6,055,826 A * 5/2000 Hiraoka et al. ..... 62/408
6,058,723 A * 5/2000 Kusunoki ..... F25D 17/065 62/155
6,314,746 B2 * 11/2001 Ohya et al. ..... 62/187
6,381,982 B1 * 5/2002 Kim ..... 62/407
6,497,113 B1 * 12/2002 Yamada et al. ..... 62/441
6,604,377 B2 * 8/2003 Kameda ..... F25D 11/022 62/408
7,032,407 B2 4/2006 Chastine
8,191,382 B2 * 6/2012 Lim ..... F25D 11/022 62/441
2003/0005720 A1 * 1/2003 Lee ..... F25D 23/003 62/452
2003/0140641 A1 * 7/2003 Lee ..... F25D 17/062 62/186
2004/0031275 A1 * 2/2004 Cho ..... F25D 17/045 62/179
2004/0055321 A1 * 3/2004 Kempiak ..... 62/255
2004/0107724 A1 * 6/2004 Kim et al. ..... 62/408
2004/0144128 A1 * 7/2004 Junge ..... F25D 17/045 62/441
2004/0188935 A1 * 9/2004 Nam ..... F25D 17/045 273/255
2005/0126207 A1 6/2005 Lee et al.
2005/0132730 A1 * 6/2005 Lim ..... F25D 17/062 62/157
2005/0204773 A1 * 9/2005 Imai ..... F25B 1/10 62/512
2005/0210909 A1 * 9/2005 Kim et al. ..... 62/340
2006/0260333 A1 * 11/2006 Wetekamp et al. ..... 62/135
2006/0260344 A1 * 11/2006 Martin et al. ..... 62/340
2006/0260345 A1 * 11/2006 Coulter et al. ..... 62/340
2006/0260350 A1 * 11/2006 Van Meter et al. ..... 62/407
2006/0266059 A1 * 11/2006 Wetekamp et al. ..... 62/187
2007/0163291 A1 * 7/2007 Kim ..... F25D 17/065 62/408
2008/0155994 A1 * 7/2008 Miyamoto et al. ..... 62/6
2008/0190125 A1 * 8/2008 Yoshioka ..... F25B 1/10 62/208
2009/0133432 A1 * 5/2009 Lee ..... D06F 31/00 62/441
2009/0250190 A1 * 10/2009 Siegenthaler ..... B60H 1/00014 165/42
2009/0277210 A1 * 11/2009 Eveland et al. ..... 62/441
2010/0050665 A1 3/2010 Oswald et al.
2010/0083687 A1 * 4/2010 Handa et al. ..... 62/419
2010/0125365 A1 * 5/2010 Ahn ..... F25D 17/065 700/275
2010/0139307 A1 * 6/2010 Kulkarni et al. ..... 62/407
2010/0147003 A1 * 6/2010 Ueda ..... A23B 4/066 62/314
2010/0162747 A1 * 7/2010 Hamel et al. ..... 62/441
2010/0236269 A1 * 9/2010 Mamemoto ..... A23B 7/0425 62/331
2010/0257876 A1 * 10/2010 Anell ..... F25D 17/065 62/74
2010/0300137 A1 * 12/2010 Lim et al. ..... 62/419
2011/0011118 A1 * 1/2011 Cho et al. ..... 62/419
2011/0289945 A1 * 12/2011 Choi ..... F25D 21/002 62/80
2012/0024001 A1 2/2012 Oh et al.
2012/0272670 A1 * 11/2012 Choi ..... F25D 17/065 62/89
2012/0272674 A1 * 11/2012 Lim ..... F25D 29/00 62/218
2013/0327073 A1 * 12/2013 Lee ..... F25B 49/02 62/131
2014/0013793 A1 * 1/2014 Junge ..... 62/419
2014/0260368 A1 * 9/2014 Wintemute ..... F25B 6/04 62/89
2014/0338379 A1 * 11/2014 Hatakeyama ..... F25B 30/02 62/126

* cited by examiner

AIR FLOW DESIGN FOR CONTROLLING TEMPERATURE IN A REFRIGERATOR COMPARTMENT

FIELD OF THE INVENTION

The invention relates generally to refrigerators with a freezer and refrigerator compartment, and more particularly to controlling air flow between the freezer and refrigerator compartment.

BACKGROUND OF THE INVENTION

A common household refrigerator design includes a refrigerator or fresh food compartment configured in a cabinet with a freezer compartment. One configuration includes the refrigerator compartment located above the freezer compartment or visa-versa. Another design includes the refrigerator and freezer compartment located side-by-side. In refrigerators, cold air may be ducted from the freezer compartment to the refrigerator compartment; return ducts may be configured to return relatively warm air from the refrigerator compartment to the freezer compartment. In either case, ductwork is often used to move air flow between the compartments to control the temperature, for example, of the refrigerator compartment. In some instances two or more ducts may be configured between the compartments and used as dedicated return ducts for returning relatively warm air to the freezer compartment from the refrigerator compartment. Other ducts may be dedicated entirely as supply ducts between the refrigerator and freezer compartment. Using dedicated ducting or ductwork to control temperature, for example, in the refrigerator compartment unnecessarily increases the amount of ductwork in the refrigerator, the cost of the refrigerator and complicates the design.

Therefore, the proceeding disclosure provides improvements over existing designs.

SUMMARY OF THE INVENTION

According to one exemplary aspect, a refrigerator with a cabinet having a freezer compartment and refrigerator compartment is disclosed. The refrigerator may be configured to include a first air return pathway between the refrigerator compartment and the freezer compartment for returning relatively warm air from the refrigerator compartment to the freezer compartment. A second air return pathway may also be configured between the refrigerator compartment and the freezer compartment. A fan may be associated with the first or second air return pathway that when activated the first or second air return pathway acts as an air supply pathway to supply cold air from the freezer compartment to the refrigerator compartment.

According to another exemplary aspect, a refrigerator having a cabinet with first and second temperature controlled compartments is disclosed. The refrigerator also includes a pair of air return ducts between the temperature controlled compartments for returning relatively warm air from the first to the second temperature controlled compartment. One of the air return ducts is switchable between an air return and air supply duct to return air to the second from the first temperature controlled compartment; and supply air to the first from the second temperature controlled compartment.

According to another exemplary aspect, a method for controlling temperature in a refrigerator is disclosed. The method includes providing a cabinet having a freezer compartment and refrigerator compartment and first and second air pathways between the compartments. Some possible steps include, for example, returning relatively warm air to the freezer compartment from the refrigerator compartment through both the first and second air pathways and reversing direction of air flow in the first or second air pathway for supplying cold air to the refrigerator compartment from the freezer compartment.

According to another exemplary aspect, a refrigerator is disclosed. The refrigerator includes a refrigerator cabinet divided into upper and lower compartments, wherein the lower compartment is a freezer compartment and the upper compartment is a refrigerator. The refrigerator also includes a first return duct between the fresh food compartment and the freezer compartment for returning relatively warm air from the refrigerator compartment to the freezer compartment, a second return duct between the refrigerator compartment and the freezer compartment for returning air from the refrigerator compartment to the freezer compartment, and a fan associated with the second return duct, such that when the fan is activated the second return duct acts as a supply duct to supply cold air from the freezer compartment to the refrigerator compartment. In one aspect, the refrigerator also includes an electronic control system operatively connected to the fan and configured to control the fan, wherein the electronic control system is configured to activate the fan in response to a temperature setting requiring additional cooling in the refrigerator compartment.

According to another exemplary aspect, a method of controlling airflow within a refrigerator is disclosed. A refrigerator includes (a) a refrigerator cabinet divided into upper and lower compartments, wherein the lower compartment is a freezer compartment and the upper compartment is a refrigerator compartment, (b) a first return duct between the fresh food compartment and the freezer compartment for returning relatively warm air from the refrigerator compartment to the freezer compartment, (c) a second return duct between the refrigerator compartment and the freezer compartment, and (d) a fan associated with the second return duct, such that when the fan is activated the second return duct acts as a supply duct to supply cold air from the freezer compartment to the refrigerator compartment. A fan is activated in response to a temperature setting requiring additional cooling in the refrigerator compartment to thereby supply cold air from the freezer compartment to the refrigerator compartment using the second return duct and thereby reversing airflow associated with the second return duct. In one aspect of the method, activation of the fan is performed using an electronic control system.

According to still another exemplary aspect, a refrigerator is disclosed that includes a refrigerator cabinet, a freezer compartment disposed within the refrigerator cabinet, and a temperature controlled compartment within the refrigerator cabinet. The temperature controlled compartment may be positioned above the freezer compartment. A first return duct is disposed between the temperature controlled compartment and the freezer compartment for returning relatively warm air from the temperature controlled compartment to the freezer compartment and a second return duct is disposed between the temperature controlled compartment and the freezer compartment for returning air from the temperature controlled compartment to the freezer compartment. A fan is associated with the second return duct, such that when the fan is activated the second return duct acts as a supply duct to supply cold air from the freezer compartment to the refrigerator compartment to decrease temperature within the temperature-controlled compartment.

BRIEF DESCRIPTION OF THE DRAWINGS

While the specification concludes with claims particularly pointing out and distinctly claiming the invention, it is believed that the various exemplary aspects of the invention will be better understood from the following description taken in conjunction with the accompanying drawings, in which:

DETAILED DESCRIPTION OF THE PREFERRED EMBODIMENTS

Figure 1:
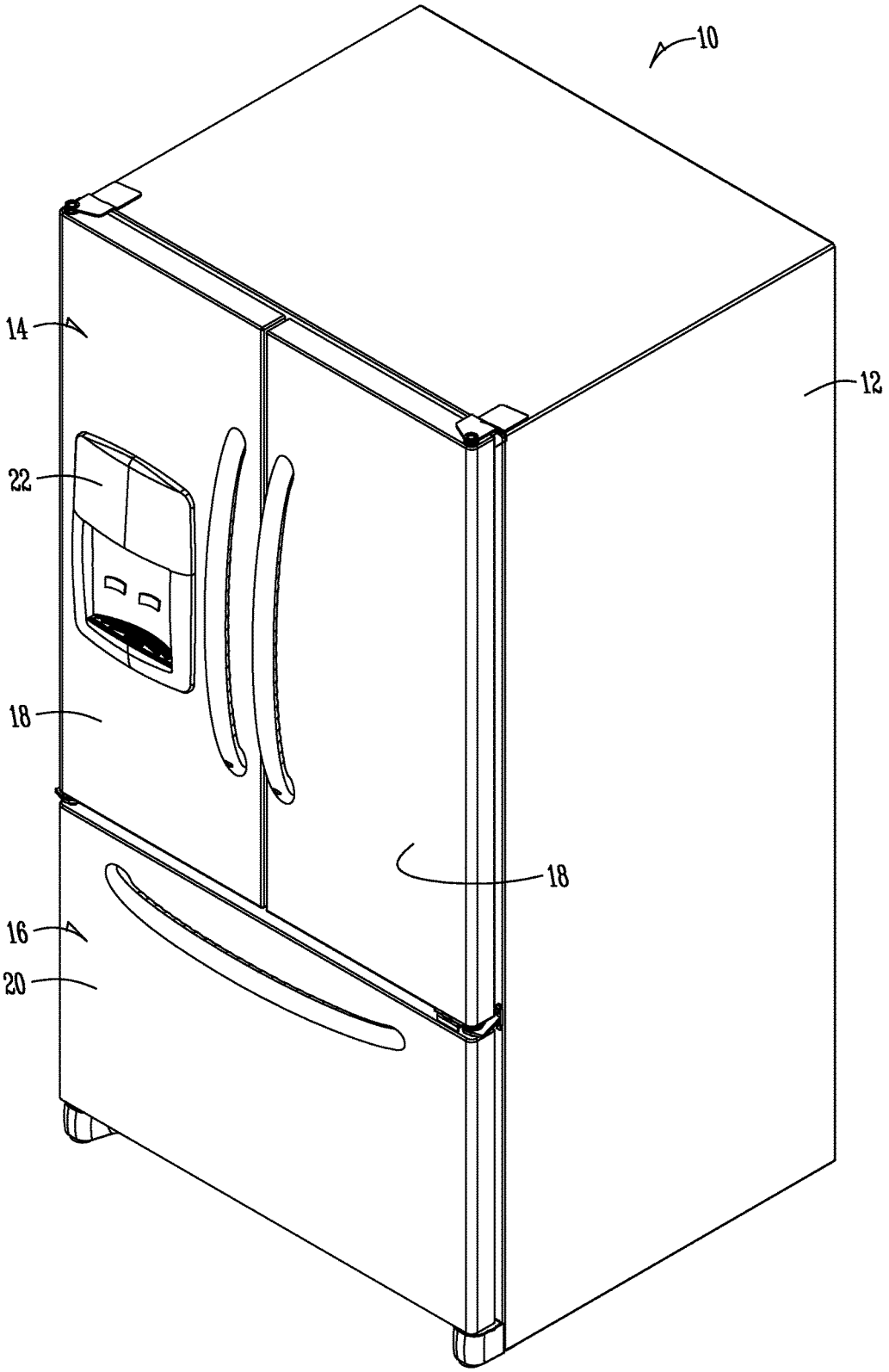
FIG. 1 is a perspective view of a refrigerator in accordance with an exemplary aspect of the invention.

By way of illustration, FIGS. 1-4 provide exemplary features, aspects and embodiments for a refrigerator 10 of the present invention. The refrigerator 10 includes a cabinet body 12 with a refrigerator compartment or fresh food compartment 14 selectively closeable by a refrigerator compartment door 18 and a freezer compartment 16 selectively closeable by a freezer compartment door 20. A dispenser 22 may be included on the refrigerator compartment door 18 for providing dispensions of liquid and/or ice at the refrigerator compartment door 18. Although one particular design of a refrigerator 10 is shown in FIG. 1 and replicated throughout various figures of the present invention, other refrigerator styles and configurations are contemplated. For example, the refrigerator 10 could be a side-by-side refrigerator, a refrigerator with the freezer compartment positioned above the refrigerator compartment (top-mount refrigerator), a refrigerator with the freezer compartment positioned beneath the refrigerator compartment (bottom-mount refrigerator), a refrigerator that includes only a refrigerator or fresh food compartment and no freezer compartment, etc. In the figures is shown a bottom-mount refrigerator 10 where the freezer compartment 16 is located below the refrigerator compartment 14.

Figure 2:
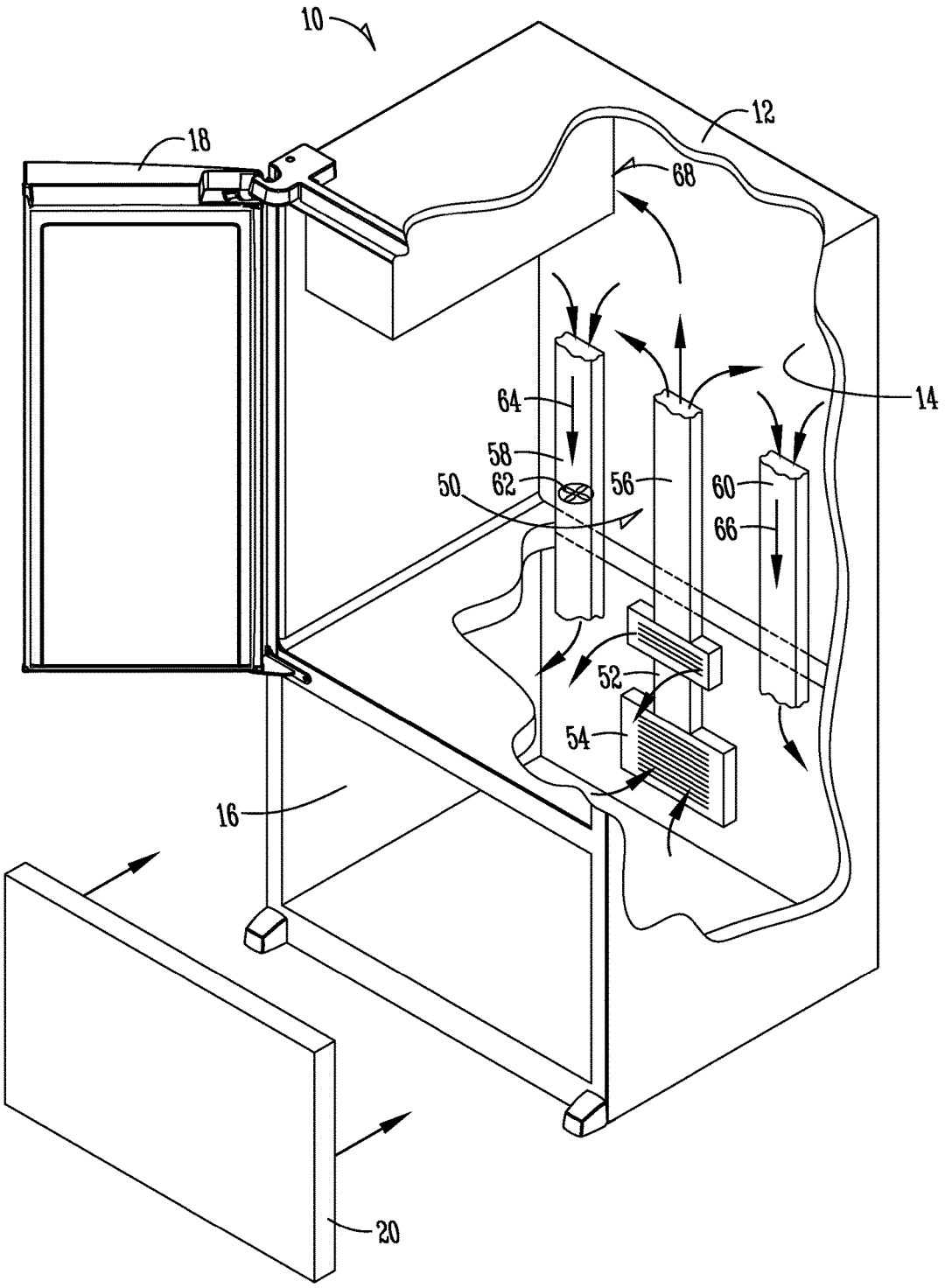
FIG. 2 is a perspective view illustrating one mode of operation for an air flow system according to an exemplary aspect of the invention.
Figure 3:
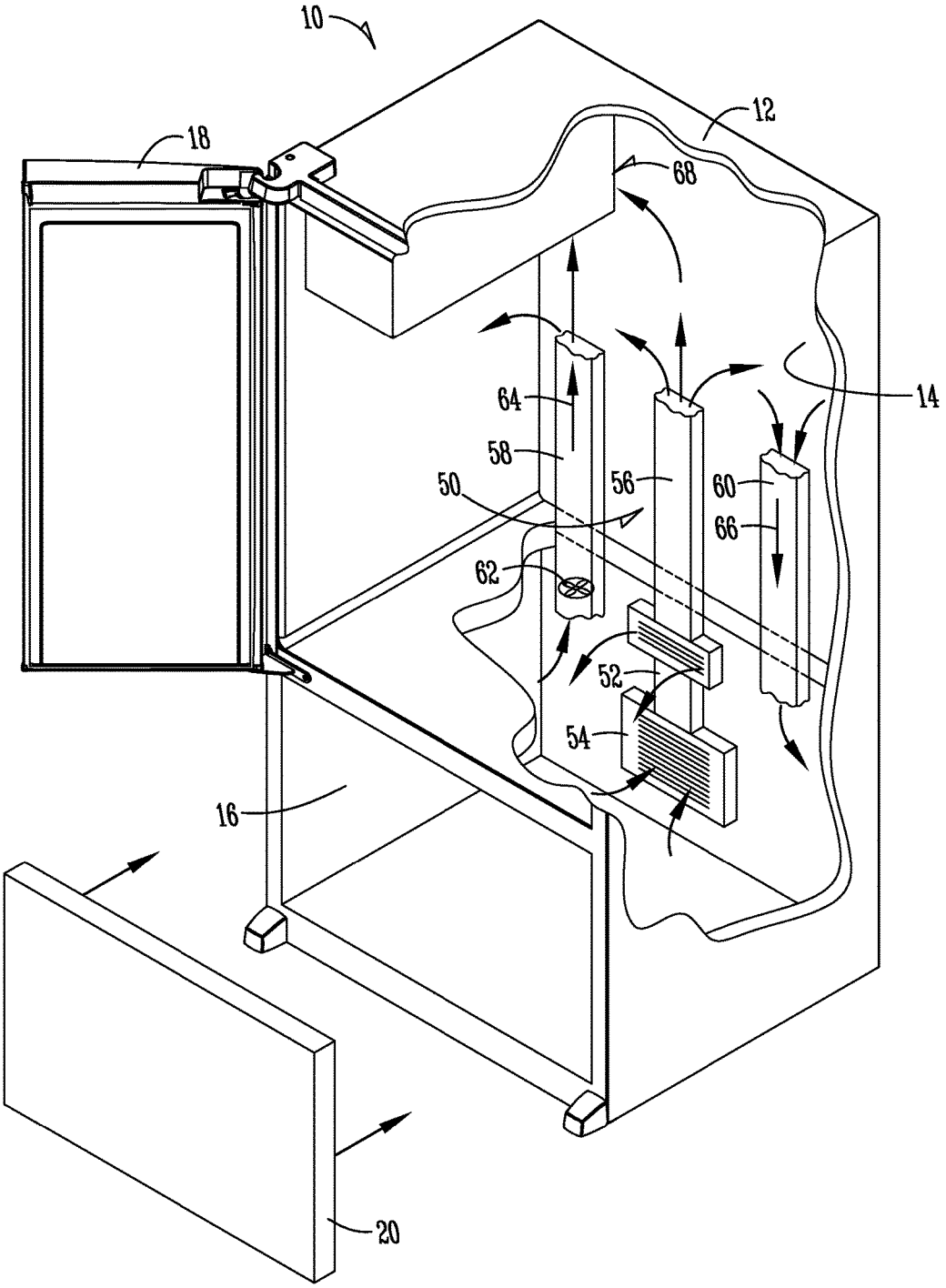
FIG. 3 is a perspective view illustrating another mode of operation for an air flow system according to an exemplary aspect of the invention.

Several aspects of the present invention are illustrated in the views of refrigerator 10 shown specifically in FIGS. 2 and 3. In connection with the refrigerator compartment 14 and the freezer compartment 16, an air flow system 50 provides flow of air between the refrigerator compartment 16 and the freezer compartment 14. The air flow system 50, according to one exemplary aspect of the disclosure, includes air supply pathway 52 for providing cold air to the refrigerator compartment 14 via air supply pathway 56 and to the freezer compartment 16. The air pathways for transferring air within the refrigerator compartment 14, the freezer compartment 16 or between the refrigerator compartment 14 and the freezer compartment 16 may be configured as air ducts, channels or conduit. The air supply pathway 56 may be configured to distribute cold air to one of more locations, such as a bin, drawer, temperature controlled compartment (e.g. such as temperature controlled compartment 68), shelf, or other designated area within the refrigerator compartment 14 or on the refrigerator compartment door 18. Relatively warmer air within the refrigerator compartment is returned to the freezer compartment through air return pathway 58 and air return pathway 60. Most commercial refrigerators are equipped with air return pathways such as air return pathway 58 and air return pathway 60. The relatively warmer air communicated from the refrigerator compartment 14 to the freezer compartment 16 through air return pathway 58 in the direction of arrow 64 and air return pathway 60 in the direction of arrow 66. The return air is taken into the air return pathway 54 in the freezer compartment 16. Heat is extracted from the relatively warm air taken from the refrigerator compartment so as to cool the air which is then communicated through air supply pathway 52 for cooling the freezer compartment 16 and through air supply pathway 56 for chilling the refrigerator compartment 14. Thus, in the exemplary air flow system 50 illustrated in the figures, relatively warm air is taken from the refrigerator compartment 14 and communicated to the freezer compartment through air return pathway 58 in the direction of arrow 64 and air return pathway 60 in the direction of arrow 66. In the configuration shown in FIG. 2, cooling within the refrigerator compartment, a bin, a shelf or within a temperature controlled compartment (such as temperature controlled compartment 68), is accomplished as previously described.

To provide additional or supplemental cooling to a bin, shelf, temperature controlled compartment 68, ice maker, ice storage bin, or other defined space within the refrigerator compartment or on the refrigerator compartment door 18 generally requires that other air flow pathways or ductwork be configured into the refrigerator 10 to supply the additional cold air. The additional ductwork or air pathways configured into the refrigerator 10 unnecessarily increase the cost of the refrigerator 10, the amount of ductwork in the refrigerator 10 and complicates the design of the air flow system 50.

FIG. 3 illustrates, according to an exemplary aspect of the disclosure, a configuration of the air flow system 50 shown in FIG. 2 that allows or provides additional cooling or supplemental cooling to any of the aforementioned areas within a refrigerator compartment 14 or on a refrigerator compartment door 18 without having to increase the amount of ductwork or air flow pathways within the refrigerator, the cost of the refrigerator or the complexity of the design of the air flow system 50. As indicated above, and as shown in FIG. 2, relatively warmer air from the refrigerator compartment 14 returns to the freezer compartment 16 simultaneously through air return pathway 58 in the direction of arrow 64 and air return pathway 60 in the direction of arrow 66. To provide additional or supplemental cooling to a specific area within the refrigerator compartment 14 or on the refrigerator compartment door 18 a fan 62 or other means for moving air from one location to another may be configured in operable communication with one of the air return pathways 58 or 60. By way of example, FIG. 3 illustrates a fan 62 configured in operable communication with the air return pathway 58. The fan 62 may be configured within the refrigerator compartment 14 (as shown in FIG. 2) or within the freezer compartment 16 (as shown in FIG. 3). If configured in the refrigerator compartment 14 as shown in FIG. 2, the fan 62 upon activation pulls cold air from the freezer compartment 16 into the refrigerator compartment 14 through the air return pathway 58 in the direction of arrow 64 shown in FIG. 3. Thus, the direction of air flow in the air return pathway 58 is switched from its normal direction of flow 64 shown in FIG. 2 (i.e., relatively warmer air being communicated from the refrigerator compartment to the freezer compartment) so that cold air is communicated from the freezer compartment 16 to the refrigerator compartment 14 through the air return pathway 58 simultaneously while relatively warm air is returned to the freezer compartment 16 from the refrigerator compartment 14 through air return pathway 60. As previously indicated, depending on the location of the fan 62, cold air from the freezer compartment 16 may be pulled into the refrigerator compartment 14 through air return pathway 58 if the fan 62 is positioned in the refrigerator compartment (see FIG. 2) or pushed into the refrigerator compartment from the freezer compartment 16 if the fan 62 is positioned within the freezer compartment 16 as shown, by way of example, in FIG. 3. Upon deactivation of the fan 62, the air return pathway 58 returns to its normal operation shown in FIG. 2, akin to the operation of air return pathway 60, returning relatively warm air from the refrigerator compartment 14 to the freezer compartment 16. Thus, at any time, the fan 62 or other means for moving air through an air pathway may be activated to reverse the flow of air 64 through the air return pathway 58 to communicate cold air from the freezer compartment 16 to the refrigerator compartment 14 while relatively warm air continues to return from the refrigerator compartment 14 to the freezer compartment 16 through the air return pathway 60 in the direction of arrow 66 as shown in FIG. 3. Also contemplated, is a configuration of the air flow system 50 where the direction of air flow 66 in the air return pathway 60 may be switched so as to move cold air from the freezer compartment 16 to the refrigerator compartment 14 while simultaneously returning relatively warm air from the refrigerator compartment 14 to the freezer compartment 16 through the air return pathway 58 as shown in FIG. 2. In such an embodiment, a fan similar to fan 62 may be configured in operable communication with the air return pathway 60 to switch the direction of air flow in the pathway to move cold air from the freezer compartment 16 to the refrigerator compartment 14 while warmer air is returned to the freezer compartment 16 from the refrigerator compartment 14 through air return pathway 58. Using one of the air return pathways 58 or 60 as an air supply pathway for supplying cold from the freezer compartment 16 to the refrigerator compartment 14 allows additional or supplemental cooling to be provided at specific locations within the refrigerator compartment 14 or on the refrigerator compartment door 18, such as at a temperature controlled compartment 68, a shelf, a bin or a designated area within the refrigerator compartment 14 or on the refrigerator compartment door 18. This additional cooling or supplemental cooling is provided in addition to the distribution of chilled air being provided to the refrigerator compartment 14 or refrigerator compartment door 18 through air supply pathway 56. Once the desired temperature is obtained in any of the aforementioned locations, the operation of the air return pathway 58 or 60 may be returned to normal operation where relatively warmer air within the refrigerator compartment 14 is returned to the freezer compartment 16, simultaneously for example, through both air return pathways 58 in the direction of arrow 64 and air return pathway 60 in the direction of arrow 66 as shown in FIG. 2. The figures, for purpose of illustration, show two air return pathways configured between the freezer compartment 16 and refrigerator compartment 14. The disclosure contemplates fewer or additional air return ducts between the freezer compartment 16 and refrigerator compartment 14 that may be configured to reverse the direction of air flow to move cold air from the freezer compartment 16 to the refrigerator compartment 14, to the refrigerator compartment door 18, to a bin, a shelf, a compartment (e.g., temperature controlled compartment 68), or other desired location(s).

Figure 4:
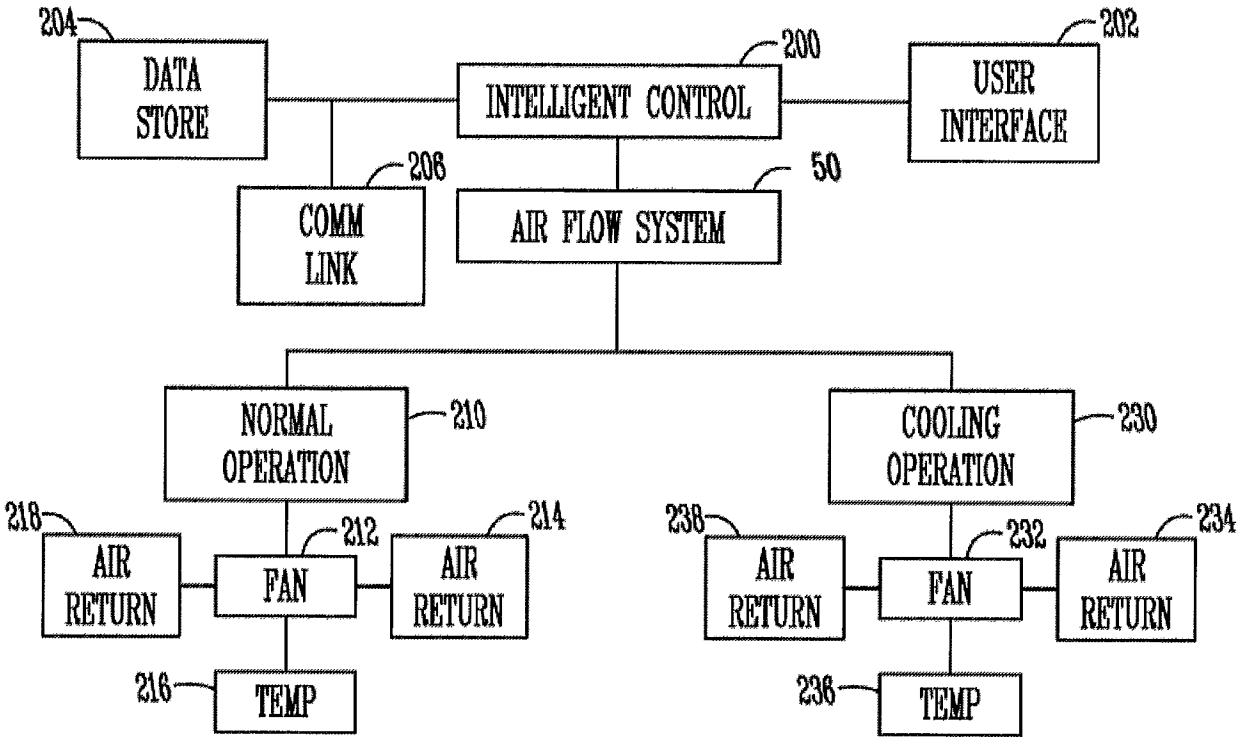
FIG. 4 is a diagram illustrating exemplary control aspects of the invention.

FIG. 4 provides a flow diagram illustrating one or more control processes for refrigerator 10 according to exemplary aspects of the disclosure. To perform one or more of the aforementioned operations or applications, the refrigerator 10 may be configured with an intelligent control 200 such as a programmable controller. A user interface 202 may be configured in operable communication with the intelligent control 200 and may be provided, such as for example, at the dispenser 22 shown in FIG. 1, on the refrigerator compartment door 18, in the refrigerator compartment 14, or at any other user-accessible location. A data store 204 for storing information associated with one or more of the operations, processes or applications of the refrigerator 10 may be configured in operable communication with the intelligent control 200. A communications link 206 may be provided for exchanging information between the intelligent control 200 in one or more processes, applications or operations of the refrigerator 10. The intelligent control 200 may also be used to control normal operation 210 or cooling operation 230 within the refrigerator compartment 14 or on the refrigerator compartment door 18. In normal operation 210, the fan 212 shown as 62 in FIGS. 2 and 3 is generally inactive or off. When the fan 212 is off or not activated, air return 218 and air return 214 recycle or return relatively warm air from the refrigerator compartment 14 to the freezer compartment 16 through, for example, air return pathways 58 and 60 as illustrated in FIGS. 2 and 3. The temperature 216 within the refrigerator compartment 14, a temperature controlled compartment 68, or other area within the refrigerator compartment 14 or on the refrigerator compartment door 18 under normal operating conditions 210 is controlled by the flow of air through air supply pathway 56 which is distributed within the refrigerator compartment 14 and/or to the refrigerator compartment door 18. Upon indication of additional or supplemental cooling being needed or required at a location within the refrigerator compartment 14 or on the refrigerator compartment door 18, whether provided through the user interface 202 or by instruction from the intelligent control 200, a cooling operation 230 is commenced. According to an exemplary aspect, cooling operation 230 activates fan 232, such as fan 62 shown in FIGS. 2 and 3, to reverse the direction of air flow in air return 238 while simultaneously maintaining the return of relatively warm air from the refrigerator compartment 14 to the freezer compartment 16 in the air return 234. Thus, cold air from the freezer compartment 16 is pulled through or pushed through air return 238 into the refrigerator compartment 14 by fan 232 to control the temperature 236 of the cooling operation 230. The cooling operation 230 may be associated with, for example, a temperature controlled compartment 68 or a specific bin, drawer or other location within the refrigerator compartment 14 or on the refrigerator compartment door 18. The cooling operation 230 may also be associated with an ice making process or ice storage bin cooling process. Once the intelligent control 200 detects the temperature 236 of the cooling operation 230 has reached the set point the fan 232 is deactivated or turned off and the air return 238 returns to its normal operation allowing relatively warmer air from the refrigerator compartment 14 to return to the freezer compartment 16. As indicated above, the air return 234 may also be configured with a fan 232 to control the temperature 236 of a cooling operation 230 while relatively warmer air is simultaneously returned from the refrigerator compartment 14 to the freezer compartment 16 through the air return 238. The intelligent control 200 may also be configured to electronically control the fan 232 in the cooling operation 230 to provide variable speeds of operation or variable RPM to increase or decrease the volume of air flow from the freezer compartment 16 to the refrigerator compartment 14 through air return 238, depending upon the requested temperature 236 for the cooling operation 230. In such an embodiment, a variable speed fan or other means for moving air through an air pathway may be used and configured as illustrated in FIGS. 2 and 3. In the case where the cooling operation 230 requires or necessitates immediate cooling of, for example, a temperature controlled compartment 68, the intelligent control 200 may instruct the fan 232 to run at a higher RPM or a max RPM to move a greater or maximum volume of air from the freezer compartment 16 to the refrigerator compartment 14 through air return 238 to decrease the temperature 236 to perform the cooling operation 230 in a shorter amount of time.

The foregoing description has been presented for the purposes of illustration and description. It is not intended to be an exhaustive list or limit any of the disclosure to the precise forms disclosed. It is contemplated that other alternatives or exemplary aspects are considered included in the disclosure, the description is merely examples of embodiments. For example, the exact location of the fan or means for moving air through an air pathway and the exact air return pathway that is configured with the fan may be changed according to the type of refrigerator and/or desired performances for the refrigerator. It is understood that any other modifications, substitutions, and/or additions may be made, which are within the intended spirit and scope of the disclosure. From the foregoing, it can be seen that the disclosure accomplishes at least all of the intended objectives.

What is claimed is:

1. A refrigerator comprising:

a cabinet having a freezer compartment and a refrigerator compartment;

an intelligent control;

a user interface disposed on the refrigerator in a location accessible to a user comprising a normal operation selection and a cooling operation selection;

a first air return pathway between the refrigerator compartment and the freezer compartment;

a second air return pathway between the refrigerator compartment and the freezer compartment;

a fan associated with the first air return pathway;

a normal operation, wherein the first air return pathway returns relatively warm air from the refrigerator compartment to the freezer compartment;

a cooling operation, wherein the fan activates and urges air in the first air return pathway from the freezer compartment to the refrigerator compartment;

wherein the cooling operation is activated by the intelligent control when the user activates the cooling operation selection on the user interface.

2. The refrigerator of claim 1 wherein the cabinet is divided into upper and lower compartments, the upper compartment is the refrigerator compartment and the lower compartment is the freezer compartment.

3. The refrigerator of claim 1 wherein the fan is positioned in the refrigerator compartment to pull air into the refrigerator compartment through the first air return pathway.

4. The refrigerator of claim 1 wherein the first and second air return pathways operate simultaneously to return relatively warm air from the refrigerator compartment to an air supply pathway disposed in the freezer compartment.

5. The refrigerator of claim 1 wherein the first and second air return pathways operate simultaneously to:

a. return relatively warm air from the refrigerator compartment to the freezer compartment through the first air return pathway; and b. supply cold air from the freezer compartment to the refrigerator compartment through the second air return pathway.

6. The refrigerator of claim 1 wherein the fan is positioned in the freezer compartment to push air into the refrigerator compartment through the second air return pathway.

7. A refrigerator comprising:

a cabinet having a first temperature controlled compartment and a second temperature controlled compartment;

an electronic control;

a user interface accessible to a user comprising a normal operation selection and a cooling operation selection;

a pair of air return ducts between the temperature controlled compartments;

a normal operation, wherein the pair of air return ducts return relatively warm air from the first to the second temperature controlled compartment;

a cooling operation, wherein when the user selects the cooling operation on the user interface, one of the pair of air return ducts is switchable between an air return and air supply duct to supply air to the first temperature controlled compartment from the second temperature controlled compartment.

8. The refrigerator of claim 7 wherein the first and second temperature controlled compartments comprise refrigerator and freezer compartments respectively.

9. The refrigerator of claim 7 further comprises a fan positioned in the first or second temperature controlled compartment to switch the direction of air flow in one of the pair of air return ducts.

10. The refrigerator of claim 7 wherein the pair of air return ducts operate simultaneously to return relatively warm air from the first to the second temperature controlled compartment.

11. The refrigerator of claim 7 wherein the pair of air return ducts operate simultaneously to:

a return relatively warm air from the first to the second temperature controlled compartment through one of the pair of air return ducts; and b. supply cold air from the second to the first temperature controlled compartment through the other of the pair of return ducts.

12. The refrigerator of claim 9 wherein the electronic control is in operable communication with the fan to vary a volume of cold air supplied to the first temperature controlled compartment from the second temperature controlled compartment.

13. A method for controlling temperature in a refrigerator comprising:

providing a cabinet having a freezer compartment and a refrigerator compartment and first and second air pathways between the freezer compartment and the refrigerator compartment with a fan disposed within at least one of the first and second air pathways;

providing a user interface accessible to a user in electronic communication with an intelligent control;

returning relatively warm air to the freezer compartment from the refrigerator compartment through both the first and second air pathways;

activating a cooling operation on the user interface;

reversing direction of air flow in the first or second air pathway for supplying cold air to the refrigerator compartment from the freezer compartment.

14. The method of claim 13 further comprising returning relatively warm air simultaneously through both the first and second air pathways.

15. The method of claim 13 further comprising simultaneously:

a. returning relatively warm air from the refrigerator compartment to the freezer compartment through the first air pathway; and b. supplying cold air from the freezer compartment to the refrigerator compartment through the second air pathway.

16. The method of claim 13 further comprising reversing the direction of air flow by pulling air from the freezer compartment into the refrigerator compartment.

17. The method of claim 13 further comprising reversing the direction of air flow by pushing air into the refrigerator compartment from the freezer compartment.

18. The method of claim 13 further comprising adjusting a volume of reverse air flow by an electronic control for controlling the temperature in the refrigerator compartment.

19. The method of claim 13 further comprising directing reverse air flow from the freezer compartment into a temperature controlled compartment in the refrigerator compartment.

20. The method of claim 13 dedicating the first and second air pathways for returning relatively warm air to the freezer compartment.

* * * * *